United States Patent [19]

Strahm et al.

[11] Patent Number: 4,733,445

[45] Date of Patent: Mar. 29, 1988

[54] APPARATUS FOR EXPANDING TUBULAR MATERIAL

[75] Inventors: Christian Strahm, Bronschhofen; Paul Süss, Bettwiesen, both of Switzerland

[73] Assignee: Santex AG, Tobel, Switzerland

[21] Appl. No.: 870,987

[22] Filed: Jun. 5, 1986

[30] Foreign Application Priority Data

Jun. 5, 1985 [CH] Switzerland ..... 2434/85

[51] Int. Cl.[4] ..... D06C 5/00

[52] U.S. Cl. ..... 26/84

[58] Field of Search ..... 26/80, 81, 83, 84, 85

[56] References Cited

U.S. PATENT DOCUMENTS

| | | | |
|---|---|---|---|
| 2,553,074 | 5/1951 | Beard . | |
| 2,590,938 | 4/1952 | Cohn et al. | 26/84 |
| 3,126,606 | 3/1964 | Beard | 26/83 |
| 3,479,706 | 11/1969 | Catallo . | |

FOREIGN PATENT DOCUMENTS

| | | | |
|---|---|---|---|
| 1922938 | 11/1970 | Fed. Rep. of Germany | 26/83 |
| 1957556 | 5/1971 | Fed. Rep. of Germany | 26/85 |
| 2823978 | 12/1979 | Fed. Rep. of Germany . | |
| 46-4878 | 2/1971 | Japan | 26/84 |
| 8001084 | 5/1980 | PCT Int'l Appl. . | |

*Primary Examiner*—Robert R. Mackey
*Attorney, Agent, or Firm*—Spencer & Frank

[57] ABSTRACT

The externally held, adjustable width spreader for tubular material (1) present in a flat state is provided with two spreading and guiding units (2, 3) which are to be arranged next to one another in the interior of the tubular material. The spreading and guide units are each provided with an endless transporting belt (4) which extends along their outer guide faces and is exposed there. The transporting belts (4) and in releasable operating engagement with feed rollers (8, 9, 10, 11) disposed on the exterior of the tubular material (1) passing through.

To be able to unimpededly change the width of the spreader externally during the passage of tubular material (1), each one of the two guide units (2, 3) is held in its position by means of externally engaging support rollers (12–15) whose axes of rotation (16) are perpendicular to the direction of passage of the tubular material (1) and which are in releasable engagement with counterrollers (17–20) which are rotatably mounted in the guide units (2, 3) and are supported thereby.

To vary the spreading width of the spreader, the feed and support rollers (8–11, 12–15) associated with the one guide unit (2) are mounted in a carriage (21) so as to be jointly displaceable in the spreading direction (B).

11 Claims, 7 Drawing Figures

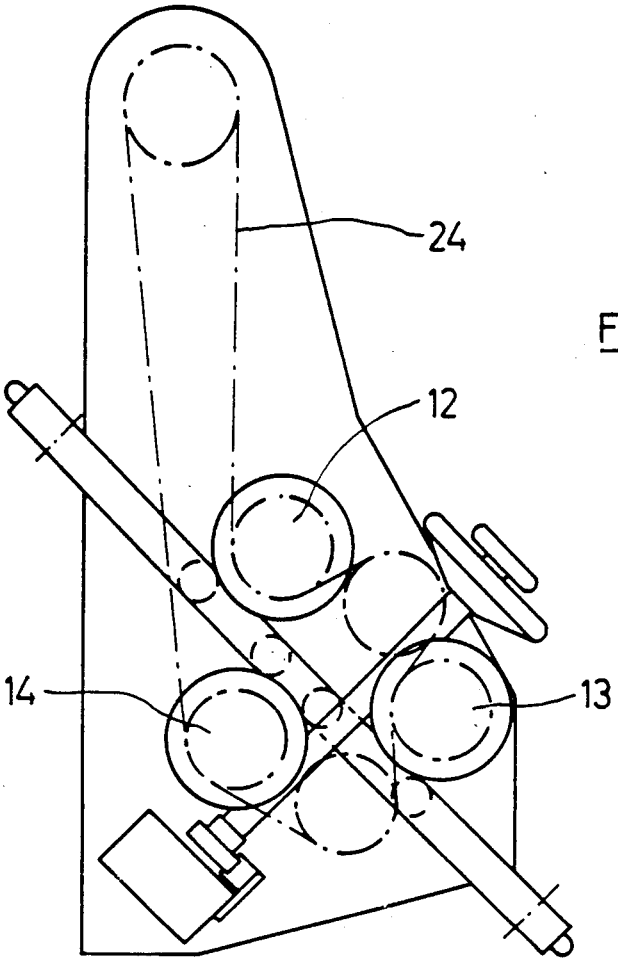
Fig. 5
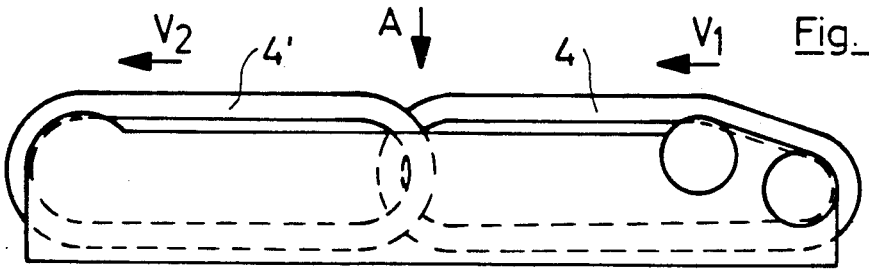
Fig. 6
Fig. 7

APPARATUS FOR EXPANDING TUBULAR MATERIAL

BACKGROUND OF THE INVENTION

1. Field of the Invention

The invention relates to an externally held, adjustable spreader for tubular materials present in a flat state. The spreader includes at least two spreading and guiding units which are laterally juxtaposed in the interior of the tubular material. Each unit is provided with at least one endless transporting belt which extends over part of its circumference along the outer guide face of the associated guide unit and is in releasable engagement with feed rollers disposed on the exterior of the tubular material to pass through.

2. Description of the Background

German Pat. No. 2,939,085 and U.S. Pat. Nos. 2,553,074 and 3,479,706 disclose spreaders disposed in the interior of a tubular material in the form of a flat frame that can be adjusted in width by means of a telescoping tube and in which the outer ends of the telescoping tubes are connected with the frame by way of head members.

However, these kwown spreaders all have the serious drawback that they are adjustable in width by way of the telescoping tubes only within relatively narrow limits. Adjustment of the spreader while tubular material is passing through, for example successive, connected tubular materials of different widths, is not possible. If the width of the tubular material passing through changes, its feed must be interrupted, the materials having the different widths must be separated from one another and the width of the spreader must be adjusted accordingly or, if its adjustment range is insufficient, the speader must be exchanged. This constitutes a very undesirable and cumbersome interruption of the work process which is desired to be as continuous as possible.

SUMMARY OF THE INVENTION

It is an object of the present invention to provide a spreader which does not have the above-mentioned drawbacks of the prior art spreaders, i.e. in which the width adjustment range can be selected at will and in which the width can be adjusted externally even if tubular material is clamped in.

This is accomplished according to the invention in a spreader of the above-mentioned type in that each one of the guide units is held in position by means of externally engaging supporting rollers whose axes of rotation extend perpendicularly to the direction of passage of the tubular material and which are in releasable engagement with counterrollers rotatably mounted in the guide units and at least the feed and support rollers associated with the one guide unit are arranged to be jointly adjustable in the spreading direction so as to change the spreading width of the spreader.

In this connection, it is advisable to have each pair of one feed roller and one support roller arranged on a common axis of rotation. To properly hold the spreading and guiding units, it is additionally advisable, when seen with respect to the plane of passage of the material, to have at least two pairs of feed and support rollers arranged on the one side of each spreading and guiding unit and at east one pair of feed and support rollers on the other side in such a manner that no tilting moment is exerted on the thus supported spreading and guiding unit.

To laterally fix the spreading and guiding units, it is advantageous for the support rollers to be provided, along their circumferences, with a guide groove which is in form locking engagement in a direction parallel to its axis of rotation with a counterroller of the spreading and guiding unit to be supported.

To realize the most uniform possible conveyance of the tubular material over the spreader, it is further advisable to connect the feed and support rollers associated with one spreading and guiding unit with a common drive.

It is additionally of advantage for the feed and support rollers disposed on the sides of a spreading and guiding unit facing away from one another to be arranged so as to be adjustable toward and away from one another.

It is additionally advisable, for the purpose of upsetting, i.e., broadening and axially shortening the tubular material being transported over the spreader, to provide each one of the two spreading and guiding units with at east two endlessly rotating transporting belts which are driven at different speeds and succeed one another along the outer guide faces.

It has further been found to be of advantage for the transporting belts to be made of a rubber elastic material and to have a circular cross section.

A more complete appreciation of the invention and many of the attendant advantages thereof will be readily perceived as the same becomes better understood by reference to the following detailed description when considered in connection with the accompanying figures.

BRIEF DESCRIPTION OF THE DRAWINGS

FIG. 5, a sectional view similar to FIG. 2 of a second exemplary embodiment of the spreader according to the invention;

FIG. 6, a schematic illustration of the arrangement of the transporting belts in a spreading and guiding unit provided with two transpoting belts that are driven at different speeds in a further exemplary embodiment of the spreader according to the invention; and FIG. 7, a view in the direction of arrow A in FIG. 6.

Figure 1:
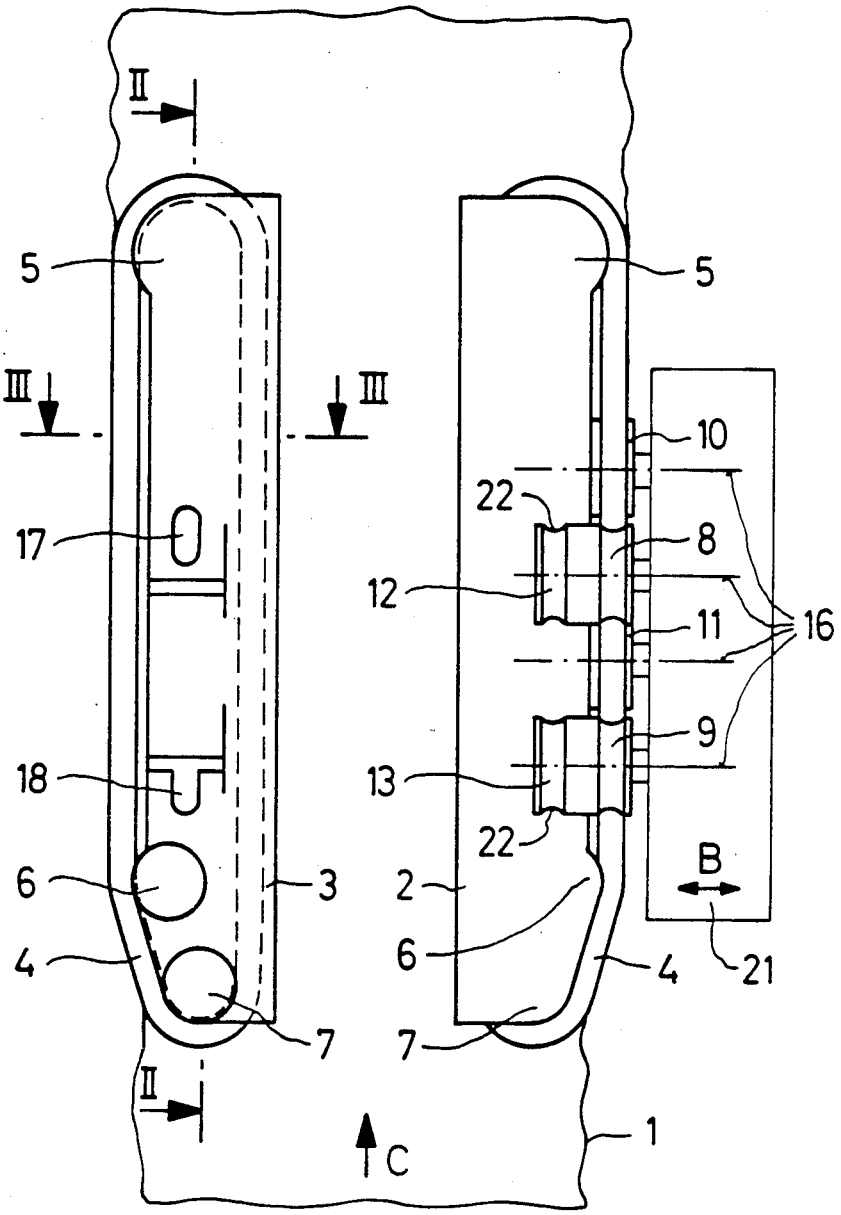
FIG. 1, a plan view of a first exemplary embodiment of a spreader according to the invention.

As can be seen in the drawing, the first exemplary embodiment of the spreader according to the invention, shown in FIGS. 1 to 4, includes two spreading and guiding units 2 and 3, arranged laterally juxtaposed in the interior of a flat knit tube 1 to be treated, with only the contours of the tube being indicated. The spreading and guiding units are each provided with an endless transporting belt 4 extending along their exterior guide faces and being guided, by means of guide rollers 5, 6 and 7 which are disposed approximately in the center plane of the tubular material in the two units 2 and 3.

The two spreading and guiding units are configured so as to taper toward the side where the tube abuts so that the incoming flat tubular knit material 1 which is to be expanded in width is quite gradually expanded in width while moving onto the spreader.

Feed rollers 8, 9, 10 and 11 which move on both sides over the exterior of the tubular material passing through and engage at it as well as support rollers 12, 13, 14 and 15 serve to hold the spreading and guiding units 2 and 3 within the tubular material 1.

Feed rollers 8 to 11 are in engagement with the portion of endlessly rotating transporting belt 4 which is exposed on the exterior guide faces of spreading and guiding units 2 and 3, respectively, drive this belt according to the desired feeding velocity of the tubular material 1 which is to be stretched in width and serve simultaneously to support the associated spreading and guiding units 2 and 3, respectively.

Figure 4:
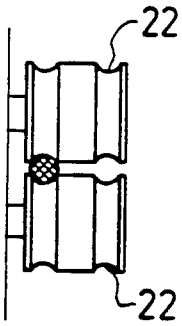
FIG. 4, a sectional view along line IV—IV of FIG. 2 of one of the two spreading and guiding units.

As can be seen particularly in FIGS. 1 and 4, the structure is simplified in that one feed roller and one support roller are combined into a pair of rollers forming a single unit whose axis of rotation 16 extends perpendicularly to the direction of passage of the tubular material 1 to be stretched. As can be seen particularly well in FIG. 2, support rollers 12 to 15 in turn are in releasable engagement with counterrollers 17, 18, 19 and 20, respectively, which are rotatably mounted in the associated spreading and guiding units 2 and 3, respectively.

To change the width of the spreader, the feed and support rollers 8 to 15 associated with the right spreading and guiding unit 2 of FIG. 1 and serving to support the latter are disposed jointly in a carriage 21 which can be displaced transversely to the feed direction C in the direction of arrow B.

Along their circumference, support rollers 12 to 15 are each provided with a guide groove 22 which is in engagement, parallel to their axis of rotation 16 and in a form locking manner, with a respective counterroller 17, 18, 19 and 20 of the spreading and guiding units 2 or 3, respectively, to be supported.

In this way, counterrollers 17, 18, 19 and 20 which engage in guide grooves 22 of support rollers 12, 13, 14 and 15, respectively, and support the latter, and feed rollers 8 to 11 which absorb the tilting moment and assure the driving of transporting belt 4 assure that the spreading and guiding members 2 and 3, respectively, are fixed in position within the passing tubular material 1, namely parallel and transversely to the direction of movement of the passing tubular material 1.

To realize a uniform feed of the tubular material 1 to be spread, all feed and support rollers 8 to 11 and 12 to 15, respectively, are given the same exterior diameters and are connected with a common drive.

To be able to take the two spreading and guiding units 2 and 3 out of the mount formed by the feed and support rollers 8 to 11 and 12 to 15, feed and support rollers 8, 9 and 12, 13 disposed on one side of spreading and guiding units 2 and 3, respectively, are mounted in a common carriage 23, which is displaceable perpendicularly to the plane of the tubular material.

Figure 2:
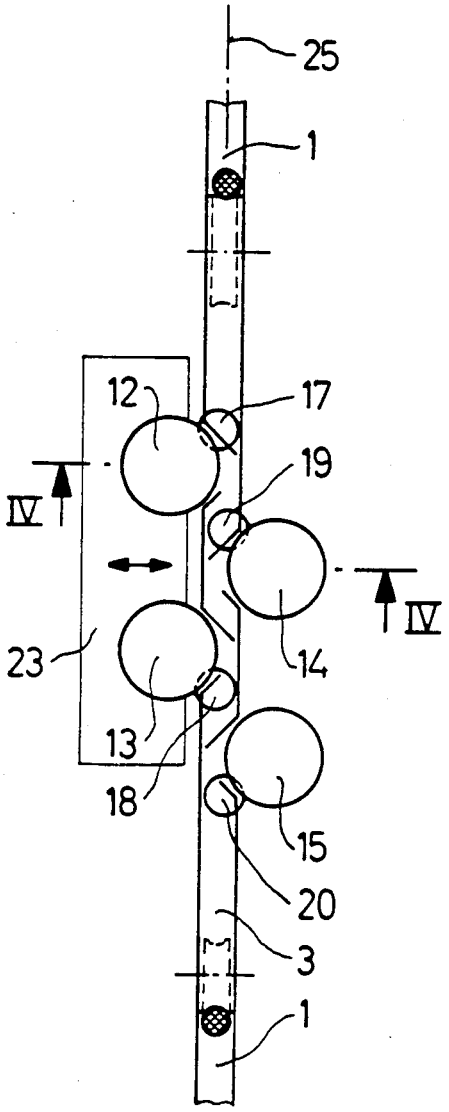
FIG. 2, a longitudinal sectional view along line II—II of FIG. 1 of one of the spreading and guiding units.
Figure 3:
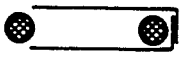
FIG. 3, a cross-sectional view along line III—III of FIG. 1 through one of the spreading and guiding units.

FIG. 5 shows a sectional view similar to FIG. 2 of a second exemplary embodiment of a spreader according to the invention, with here, in contrast to the above-described first embodiment, only three pairs of feed and support rollers 8, 9, 10 and 12, 13, 14, respectively, being provided which are driven by a joint drive chain 24. Parts analaogous to parts of the above-described first embodiment are given the same reference numerals so that a repeated description of these parts should not be necessary.

To upset the tubular material 1 transported over the spreader, each one of the two spreading and guiding units 2 and 3 may be provided, for example, with two successive endlessly rotating transporting belts 4 and 4' which are driven at different speeds along the outer guide faces of the spreading and guiding units, as this is shown very schematically in FIGS. 6 and 7. In this case, the rate of rotation $V_1$ of the first transporting belt 4 is greater than the rate of rotation $V_2$ of the second, subsequent transporting belt 4'.

At the point of transfer from transporting belt 4 to 4' the belts overlap one another.

We claim:

1. In an externally held, adjustable spreader for a tubular material which is initially in a flat state and which is movable in a first selected direction relative to the spreader, the spreader being arranged to spread the tubular material in a second selected direction perpendicular to the first selected direction, and comprising: at least two spreading and guiding units arranged to be laterally juxtaposed in the region enclosed by the tubular material, each unit having an outer guide face positioned to face outwardly of the region enclosed by the tubular material, and comprising at least one endless transporting belt having a circumference which extends in part along the outer guide face; and feed rollers arranged to be located outside the material and each releasably operatively engageable with said belt of a respective said unit, the improvement wherein said spreader further comprises:

a plurality of externally engaging support rollers, each having an axis of rotation perpendicular to the first selected direction and parallel to the second selected direction;

a plurality of counterrollers which are rotatably mounted in said units, and each releasably operatively engageable with a respective support roller so that said support rollers support said units individually and independently of one another, each said counterroller having an axis of rotation perpendicular to the first selected direction and parallel to the second selected direction; and means supporting said feed rollers and said support rollers associated with one of said units for joint displacement in the second selected direction to permit setting a desired spreading width of the spreader.

2. In an externally held, adjustable spreader for a tubular material which is movable in a selected direction relative to the spreader, the spreader comprising: at least two spreading and guiding units arranged to be laterally juxtaposed in the region enclosed by the tubular material, each unit having an outer guide face positioned to face outwardly of the region encosed by the tubular material, and comprising at least one endless transporting belt having a circumference which extends in part along the outer guide face; and feed rollers arranged to be located outside the material and each releasably operatively engageable with said belt of a respective said unit, the improvement wherein said spreader further comprises:

a plurality of externally engaging support rollers, each having an axis of rotation perpendicular to the selected direction of movement of the material, a plurality of counterrollers which are rotatably mounted in said units, and each releasably operatively engageable with a respective support roller; and means supporting said feed rollers and said support rollers associated with one of said units for joint displacement in a direction perpendicular to the direction of movement of the material to permit setting a desired spreading width of the spreader, and wherein each feed roller has a common axis of rotation, and forms a roller pair, with a respective support roller; and to prevent the exertion of tilting moments on each said unit, at least two roller pairs are placed on one side of each said unit with respect to the direction of movement of the material and at least one roller pair is placed on the opposite side.

3. The spreader of claim 2, wherein each support roller is further provided along its circumference and parallel to its axis with a guide groove which is in locking engagement with the corresponding counterroller.

4. The spreader of claim 2, further comprising a common drive connected to said feed rollers and said support rollers associated with said units.

5. The spreader of claim 2, wherein each said unit further comprises at least one further endless transporting belt which is placed in succession of the endless transporting belt along the direction of movement of the material; each transporting belt moving at a respectively different speed to upset the tubular material.

6. The spreader of claim 5, wherein all transporting belts are made of a rubber-elastic material and have a circular cross-section.

7. In an externally held, adjustable spreader for a tubular material which is movable in a selected direction relative to the spreader, the spreader comprising: at least two spreading and guiding units arranged to be laterally juxtaposed in the region enclosed by the tubular material, each unit having an outer guide face positioned to face outwardly of the region enclosed by the tubular material, and comprising at least one endless transporting belt having a circumference which extends in part along the outer guide face; and feed rollers arranged to be located outside the material and each releasably operatively engageable with said belt of a respective said unit, the improvement wherein said spreader further comprises:

a plurality of externally engaging support rollers, each having an axis of rotation perpendicular to the selected direction of movement of the material;

a plurality of counterrollers which are rotatably mounted in said units, and each releasably operatively engageable with a respective support roller; and means supporting said feed rollers and said support rollers associated with one of said units for joint displacement in a direction perpendicular to the direction of movement of the material to permit setting a desired spreading width of the spreader, and wherein each said unit has two sides facing away from one another, each feed roller and each support roller is disposed adjacent a respective side of a respective unit, and said support rollers and said feed rollers adjacent one side of one said unit are movable toward and away from said support rollers and said feed rollers adjacent the other side of said one unit.

8. The spreader of claim 7, wherein each support roller is further provided along its circumference and parallel to its axis with a guide groove which is in locking engagement with the corresponding counterroller.

9. The spreader of claim 7, further comprising a common drive connected to said feed rollers and said support rollers associated with said units.

10. The spreader of claim 7, wherein each said unit further comprises at least one further endless transporting belt which is placed in succession of the endless transporting belt along the direction of movement of the material; each transporting belt moving at a respectively different speed to upset the tubular material.

11. The spreader of claim 10, wherein all transporting belts are made of a rubber-elastic material and have a circular cross-section.

* * * * *